US009833084B2

(12) United States Patent
Roekens et al.

(10) Patent No.: US 9,833,084 B2
(45) Date of Patent: Dec. 5, 2017

(54) MERCHANDISER

(71) Applicant: The Coca-Cola Company, Atlanta, GA (US)

(72) Inventors: Jurgen Roekens, Kampenhout (BE); Bart Carpentier, Zoersel (BE); David Pas, Antwerp (BE); Michael J. Kline, Marietta, GA (US)

(73) Assignee: The Coca-Cola Company, Atlanta, GA (US)

( * ) Notice: Subject to any disclaimer, the term of this patent is extended or adjusted under 35 U.S.C. 154(b) by 9 days.

(21) Appl. No.: 14/273,587

(22) Filed: May 9, 2014

(65) Prior Publication Data

US 2014/0246452 A1 Sep. 4, 2014

Related U.S. Application Data

(63) Continuation of application No. 12/828,345, filed on Jul. 1, 2010, now Pat. No. 8,757,434.

(51) Int. Cl.

| | |
|---|---|
| ***B65H 3/44*** | (2006.01) |
| ***A47F 1/12*** | (2006.01) |
| ***A47F 3/04*** | (2006.01) |
| ***G07F 9/10*** | (2006.01) |
| ***G07F 11/08*** | (2006.01) |

(Continued)

(52) U.S. Cl.

CPC ..... *A47F 1/12* (2013.01); *A47F 3/0491* (2013.01); *G07F 9/105* (2013.01); *G07F 11/08* (2013.01); *G07F 11/10* (2013.01); *G07F 11/42* (2013.01); *G07F 11/52* (2013.01); *G07F 11/58* (2013.01); *G07F 17/0071* (2013.01); *G07F 17/0078* (2013.01)

(58) Field of Classification Search

CPC ..... A47F 1/12; A47F 3/0491; G07F 9/105; G07F 11/08; G07F 11/10; G07F 11/42; G07F 11/52; G07F 11/28; G07F 17/0071; G07F 17/0078

USPC ..... 221/66, 1, 97, 82, 150 R, 150 HC, 120, 221/151, 93; 194/4, 4 C

See application file for complete search history.

(56) References Cited

U.S. PATENT DOCUMENTS

| | | | | |
|---|---|---|---|---|
| 882,858 A | | 3/1908 | Alexander et al. | |
| 2,250,557 A | * | 7/1941 | Tull | F25D 17/06 62/380 |

(Continued)

FOREIGN PATENT DOCUMENTS

| | | |
|---|---|---|
| FR | 2626757 A1 | 1/1989 |
| FR | 2641887 A1 | 7/1990 |

(Continued)

OTHER PUBLICATIONS

U.S. Appl. No. 12/828,345, filed Jul. 1, 2010, Roekens, et al.

*Primary Examiner* — Rakesh Kumar

(74) *Attorney, Agent, or Firm* — Susanne Hollinger; Jim Patterson

(57) ABSTRACT

The present application provides a merchandiser. The merchandiser may include an ambient compartment with at least one ambient product therein, a temperature controlled compartment with at least one temperature controlled product therein, and a vending module in communication with the temperature controlled compartment such that the vending module dispenses a temperature controlled product in response to an ambient product being placed in the vending module.

20 Claims, 6 Drawing Sheets

(51) Int. Cl.

| | |
|---|---|
| ***G07F 11/10*** | (2006.01) |
| ***G07F 11/42*** | (2006.01) |
| ***G07F 11/52*** | (2006.01) |
| ***G07F 11/58*** | (2006.01) |
| ***G07F 17/00*** | (2006.01) |

(56) References Cited

U.S. PATENT DOCUMENTS 2,254,208 A 9/1941 Buford
2,260,643 A * 10/1941 Rosan ..... G07F 7/0609 211/59.2
2,266,025 A * 12/1941 Grau ..... G07F 11/52 221/150 R
2,371,845 A * 3/1945 Robison ..... G07F 11/04 221/250
2,408,444 A 10/1946 Payne
2,496,304 A * 2/1950 Muffly ..... F25D 17/02 194/277
2,671,001 A 3/1954 Ossanna, Jr.
2,711,241 A * 6/1955 Abrahamsen ..... F25D 25/00 193/27
2,956,660 A * 10/1960 Nordquist ..... G07F 11/34 194/346
3,055,548 A * 9/1962 Allegri ..... A47F 1/10 221/131
3,231,323 A * 1/1966 Wells ..... A47F 1/12 221/6
3,294,282 A 12/1966 Brown
4,248,358 A * 2/1981 Muench ..... G07F 9/105 221/150 A
4,252,250 A 2/1981 Toth
4,287,992 A * 9/1981 Takemori ..... A47F 1/087 211/59.2
4,325,227 A 4/1982 Ibrahim
4,361,012 A 11/1982 Ibrahim
4,411,351 A * 10/1983 Lowder ..... G07F 7/0609 194/212
4,478,047 A 10/1984 Ibrahim
4,615,169 A 10/1986 Wurmli
4,687,119 A * 8/1987 Juillet ..... G07F 9/105 221/101
4,823,982 A 4/1989 Aten et al.
4,823,984 A * 4/1989 Ficken ..... F25D 19/00 221/126
4,919,250 A 4/1990 Olson et al.
4,920,763 A * 5/1990 Provest ..... F25D 17/02 62/378
5,009,329 A * 4/1991 Farrentine ..... G07F 11/34 221/175
5,048,719 A 9/1991 Empl et al.
5,201,191 A * 4/1993 Bustos ..... A47F 3/0408 211/187
5,237,835 A * 8/1993 Brochier ..... F25D 17/02 62/336
5,247,798 A * 9/1993 Collard, Jr. ..... F25B 21/02 221/266
5,248,102 A * 9/1993 Bohn ..... B02C 19/0087 241/100
5,303,214 A * 4/1994 Kulakowski ..... G11B 17/225 235/385
5,335,818 A * 8/1994 Maldanis ..... G07F 11/24 221/131
5,499,707 A * 3/1996 Steury ..... G07F 7/069 186/36
5,689,967 A * 11/1997 Fl.o slashed.ysvik .... A47F 1/08 62/255
RE35,743 E * 3/1998 Pearson ..... A61G 12/001 221/123
5,890,622 A * 4/1999 Farmont ..... G07B 15/04 194/902
6,073,460 A * 6/2000 Credle, Jr. ..... A47F 3/0486 62/250
6,170,230 B1 1/2001 Chudy et al.
6,173,582 B1 * 1/2001 Hixson ..... A47F 1/087 62/3.64
6,247,610 B1 6/2001 Ziesel et al.
6,286,715 B1 9/2001 Ziesel et al.
6,390,328 B1 * 5/2002 Obermeier ..... G07F 11/24 221/203
6,499,627 B2 12/2002 Arai
6,598,789 B1 * 7/2003 Matsumoto ..... G03F 1/66 235/375
6,625,952 B1 9/2003 Chudy et al.
6,801,836 B2 10/2004 Schanin
6,808,082 B2 10/2004 Ohkubo
6,862,896 B1 * 3/2005 Seidl ..... F25D 3/08 220/592.16
7,150,155 B2 * 12/2006 Faber ..... A47F 1/06 62/381
7,228,989 B2 6/2007 Bhatti et al.
7,377,123 B2 * 5/2008 Byrne ..... G07F 11/24 221/256
7,559,482 B2 7/2009 Coveley
8,028,855 B2 * 10/2011 White ..... G07F 11/10 221/191
8,161,756 B2 * 4/2012 Kutta ..... F25D 25/04 221/150 R
8,360,272 B2 * 1/2013 Piersant ..... G07F 7/0609 221/102
9,218,704 B2 * 12/2015 Lim ..... G07F 13/065
2002/0005043 A1 * 1/2002 Rudick ..... F25B 9/14 62/6
2003/0201275 A1 10/2003 Tamura
2003/0218023 A1 * 11/2003 Zangari ..... A47F 1/087 221/150 R
2004/0026446 A1 * 2/2004 Mori ..... G07F 9/10 221/232
2004/0140317 A1 7/2004 Forte
2005/0056047 A1 * 3/2005 Carmichael ..... F25D 3/08 62/457.5
2006/0026446 A1 2/2006 Schlereth
2006/0028392 A1 2/2006 Coveley
2006/0261080 A1 11/2006 Matsumoto et al.
2008/0011771 A1 1/2008 Roekens et al.
2008/0245820 A1 10/2008 Pfister et al.
2009/0029016 A1 1/2009 Pfister et al.
2009/0076650 A1 * 3/2009 Faes ..... G07F 11/165 700/232
2010/0024913 A1 2/2010 Howard
2011/0006074 A1 * 1/2011 Machers ..... G07F 11/20 221/150 R
2011/0186591 A1 * 8/2011 Pfister ..... F25B 29/003 221/97
2012/0000744 A1 1/2012 Roekens et al.
2012/0000927 A1 1/2012 Carpentier
2012/0173016 A1 * 7/2012 Piersant ..... G07F 7/0609 700/225

FOREIGN PATENT DOCUMENTS

GB WO2004017268 A2 * 2/2004
GB WO 2004017268 A2 * 2/2004 ..... A47F 1/087
WO 00/32477 A1 6/2000
WO 2004/017268 A2 2/2004
WO 2006/036153 A1 4/2006
WO 2008057914 A2 5/2008
WO 2010/008611 A2 1/2010
WO WO 2010008611 A2 * 1/2010 ..... F25B 29/003
WO 2010149402 A1 12/2010
WO 2012/003206 A2 1/2012

* cited by examiner

MERCHANDISER

RELATED APPLICATIONS

The present application is a continuation of U.S. application Ser. No. 12/828,345, filed on Jul. 1, 2010, now allowed. U.S. application Ser. No. 12/828,345 is incorporated herein by reference in full.

TECHNICAL FIELD

The present application relates generally to merchandisers such as coolers and other types of product dispensers and more particularly relates to a merchandiser with features of an open front cooler and with the increased energy efficiency of a glass door merchandiser.

BACKGROUND OF THE INVENTION

Generally described, an open front cooler includes a refrigerated open enclosure with a number of products therein within the reach of a consumer. Because of this quick and easy accessibility and proximity to the chilled products therein, open front coolers often spur impulse purchases by consumers, who prefer chilled products to those at ambient temperatures. As a result, open front coolers generally provide an increased sales volume over conventional glass door merchandisers and the like of the same size and/or in similar locations and/or with products stored at ambient temperatures on shelves.

One drawback with conventional open front coolers, however, is that the cooler consumes several times more energy than a glass door merchandiser of the same size due to the lack of a door or other type of insulated front space. The increased sales revenue generally provided by an open front cooler thus may not cover or justify the increased energy cost.

There is thus a desire therefore for an improved open front cooler or other type of merchandiser that promotes impulse purchases and easy accessibility like an open front cooler but with the reduced energy costs of a glass door merchandiser and the like.

SUMMARY OF THE INVENTION

The present application thus provides a merchandiser as may be described herein. The merchandiser may include an ambient compartment with at least one ambient product therein, a temperature controlled compartment with at least one temperature controlled product therein, and a vending module in communication with the temperature controlled compartment such that the vending module dispenses a temperature controlled product in response to an ambient product being placed in the vending module.

The ambient compartment may include a number of ambient compartment shelves while the temperature controlled compartment may include one or more temperature controlled shelves. The vending module may include an identification module to identify each ambient product and wherein the vending module vends a temperature controlled product corresponding to the ambient product identified by the identification module.

The vending module may include an internal transport system in communication with the identification module and a vending chute. The temperature controlled compartment may include one or more temperature controlled shelves with a number of columns thereon and the vending module may include a number of column conveyor belts positioned about the number of columns. The vending module may include one or more transverse conveyor belts in communication with the number of column conveyor belts. The temperature controlled compartment may include a number of vertical chutes and the vending module may include a top conveyor belt positioned about the number of vertical chutes.

The temperature controlled compartment may include a heating/cooling module. The ambient compartment may be separate from the temperature controlled compartment. The ambient compartment may include an open compartment and/or a vending compartment.

The ambient compartment may include a closed compartment with a door and a transparent portion permitting viewing of the ambient products inside the compartment. The merchandiser also may include a payment module such that the door is accessible only upon a user completing a payment operation using the payment module.

The present application further provides a method of dispensing a number of temperature controlled products. The method may include the steps of providing a number of ambient products in and ambient compartment, providing a number of temperature controlled products in a temperature controlled compartment, identifying a selected one of the ambient products, maneuvering the selected one of the ambient products to a temperature controlled compartment, and dispensing one of the temperature controlled products that corresponds to the selected one of the ambient products. The step of providing the ambient products may include providing a number of ambient products in an open compartment or a vending compartment. The temperature controlled product may be a cooled product or a heated product.

The present application further provides a merchandiser. The merchandiser may include an open compartment with a number of ambient products positioned on a number of ambient product shelves, a temperature controlled compartment with a number of temperature controlled products positioned on one or more temperature controlled shelves, an identification module, and a vending module in communication with the temperature controlled compartment. The identification module may identify one of the ambient products and the vending module may vend one of the temperature controlled products that corresponds to the ambient product as determined by the identification module, The vending module may include an internal transport system in communication with the identification module and a vending chute. The temperature controlled compartment may include a heating/cooling module. The open compartment may be separate from the temperature controlled compartment.

These and other features and improvements of the present application will become apparent to one of ordinary skill in the art upon review of the following detailed description when taken in conjunction with the several drawings and the appended claims.

DETAILED DESCRIPTION

Figure 1:
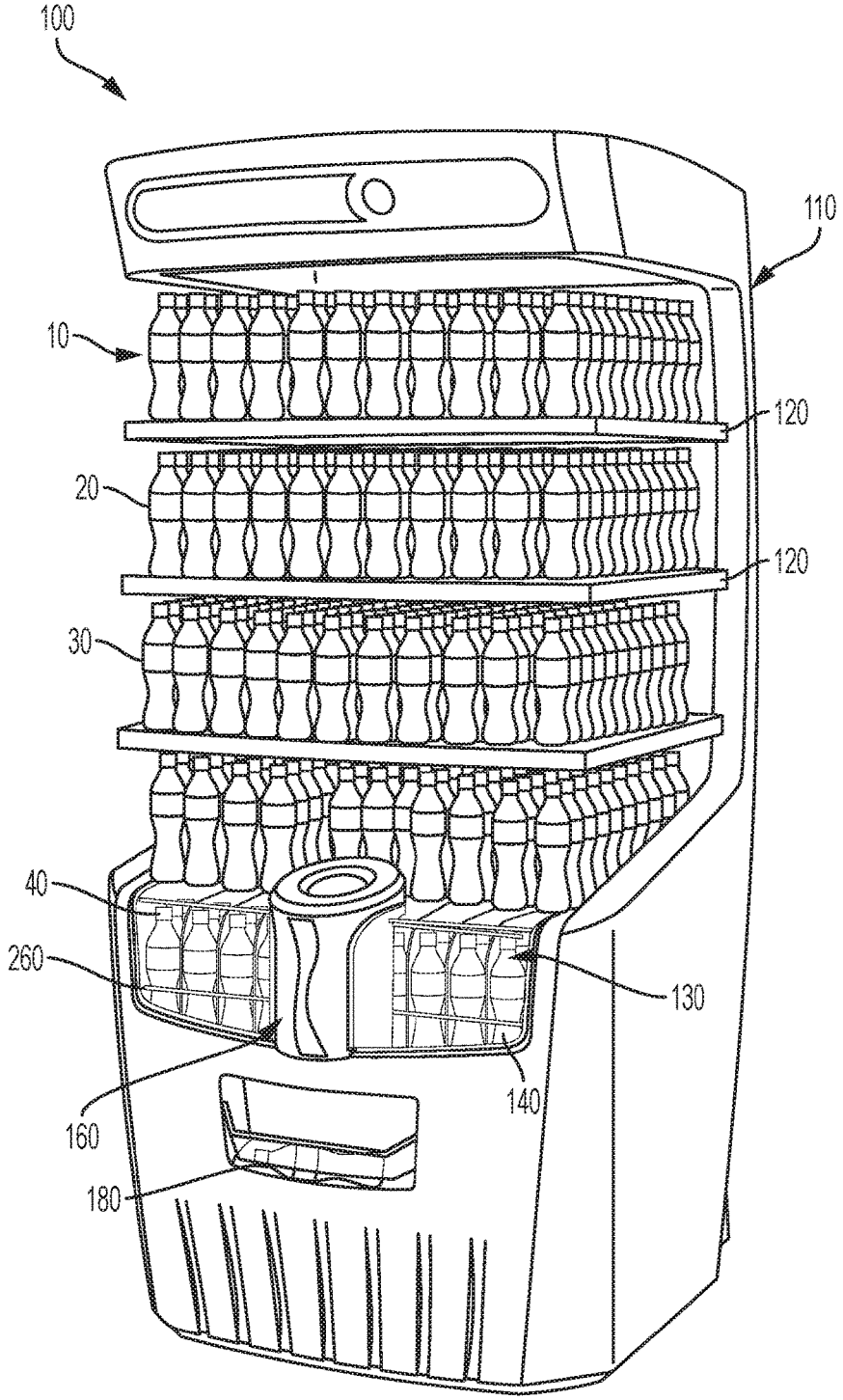
FIG. 1 is a perspective view of an example of a merchandiser as is described herein.

The present application concerns the offer for sale or other use of any number of products 10. Although the products 10 are shown, by way of example only, in the form of bottles 20, is understood that the products 10 may include any type or size of container including, but not limited to, bottles, cans, pouches, boxes, wrapped items, and/or any type of rigid or flexible packaging. The products 10 may include beverages, food items, non-food items, consumer products, and/or any type of product 10 that may be positioned on a shelf and/or that may be vended. The scope of this application is in no way limited by the nature of the products 10 intended to be used herein, while one use herein is for a chilled product 10, it will be understood that the products 10 herein may be at ambient, refrigerated, frozen, heated or at any desired temperature or state.

As will be described in more detail below, the products 10 herein may take the form of ambient products 30 and temperature controlled products 40. The ambient products 30 and the temperature controlled products 40 may or may not he the same product 10. Other product variations may be used herein.

Figure 2:
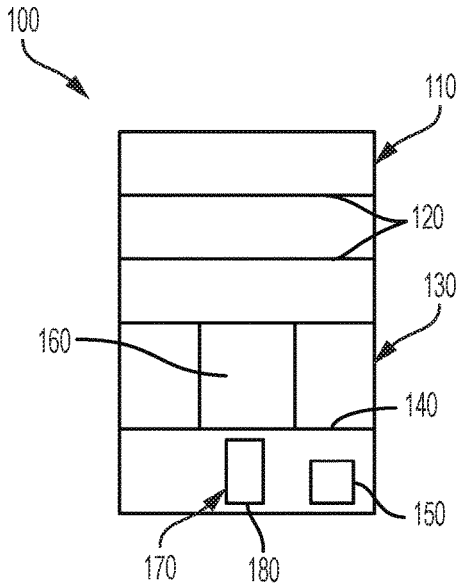
FIG. 2 is schematic view of the merchandiser of FIG. 1.

FIGS. 1 and 2 show a merchandiser 100 as may be described herein. The merchandiser 100 may include one or more open or ambient compartments 110. Each ambient compartment 110 may include a number of open or ambient compartment shelves 120. Any number of ambient compartment shelves 120 may be used. Likewise, the ambient compartment shelves 120 may have any desired shape or size. Any number of the products 10 may he placed on the ambient compartment shelves 120. Although flat shelves are shown herein, the ambient compartment shelves 120 may be any structure that may support the products 10 such as angled shelves, gravity feed shelves, neck tracker tubes, product chutes, and the like. Likewise, vertical columns and conventional vending columns also may be used. At least the front of the ambient compartment 110 may allow unimpeded access to the products 10 on the ambient compartment shelves 120.

The ambient compartment 110 described herein generally at an ambient temperature and as such is not temperature controlled. Likewise, the products 10 therein may be at an ambient temperature. Part or the entire ambient compartment 110, however, could be heated, cooled, or otherwise temperature controlled as desired at least temporarily.

The merchandiser 100 also may include a temperature controlled compartment 130. The temperature controlled compartment 130 may be enclosed and/or insulated. The temperature controlled compartment 130 may have any number of temperature controlled shelves 140. The temperature controlled shelves 140 may have any desired shape, size, or orientation. Although only one temperature controlled shelf 140 is shown, any number of shelves 140 may be used. Although fat shelves are shown herein, the temperature controlled shelves 140 may be any structure that may support the products 10 such as angled shelves, gravity feed shelves, neck tracker tubes, product chutes, and the like. Likewise, vertical columns and conventional vending columns also may be used. Although the temperature controlled compartment 130 is shown in FIGS. 1 and 2 as integral with the merchandiser 100, it is to be understood that the temperature controlled compartment 130 may operate as a stand-alone unit, allowing ambient products 10 such as on traditional store shelves or containers to be used in combination with the temperature controlled compartment 130 as described herein.

The number of ambient compartment shelves 120 is generally greater than the number of temperature controlled shelves 140, but not necessarily so. The temperature controlled compartment 130 may be at any desired temperature from freezing, chilled, ambient, warm, or hot. The temperature controlled compartment 130 may be in communication with a conventional heating/cooling module 150 and the like. Multiple temperature controlled compartments 130 with multiple temperatures also may be used herein. Although the temperature controlled compartment 130 is shown as positioned beneath the ambient compartment 110, the temperature controlled compartment 130 may be positioned on top, on the side, or, as explained below, apart from the ambient compartment 110.

The temperature controlled compartment 130 and/or the ambient compartment 110 may include a scanner or other type of identification module 160. The scanner module 160 may include a barcode scanner, an RFID tag reader, photoelectric cells, and/or any type of device that may read indicia on the product 10, identify the shape of the product 10, or otherwise identify the product 10. Alternatively, the identity of the product 10 may be entered or otherwise indicated by a consumer such as by pressing a product selection button and the like. Other types of selection means may be used herein. Although the scanner module 160 is shown as being positioned adjacent to the temperature controlled compartment 130, the scanner module 160 may be positioned in any convenient location. The scanner module 160 also may reject a product 10 that is not intended to be used with the merchandiser 100 as a whole.

The merchandiser 100 also may include a vending module 170. The vending module 170 may include a vending port 180. Although the vending port 180 is shown as being positioned adjacent to the temperature controlled compartment 130 and the scanner module 160, the vending module 170 may be positioned in any convenient location.

The vending module 170 may include an internal sport system 190. The internal transport system 190 may transport the products 10 from the scanner module 160 or other location to a location within the temperature controlled compartment 130 or otherwise. The internal transport system 190 also may transport the products 10 to the vending port 180 or otherwise as desired. Any number of internal transport system configurations may be used herein.

Figure 3:
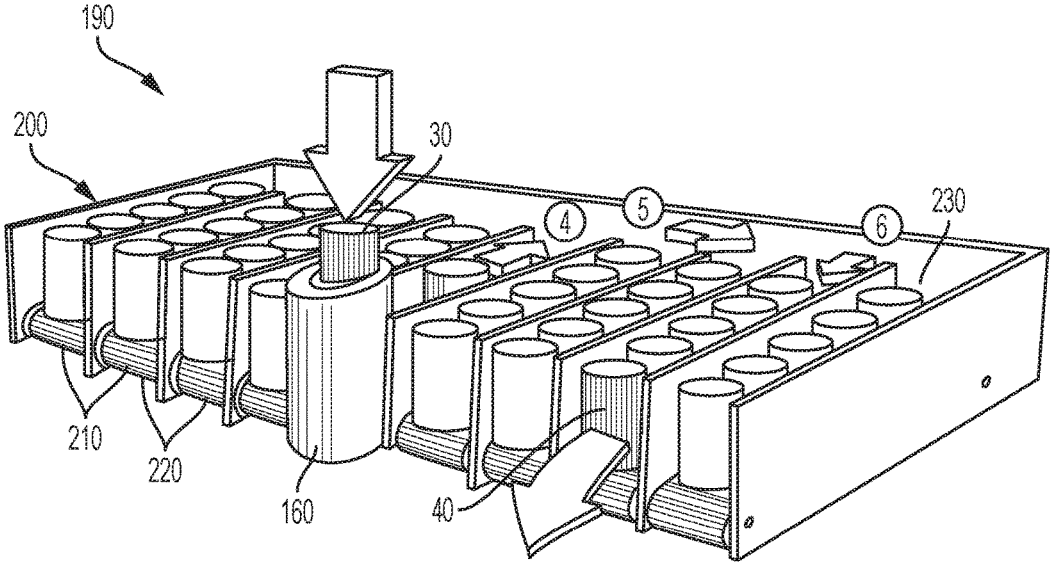
FIG. 3 is a perspective view of an internal transport system as may be used with the merchandiser of FIG. 1.

FIG. 3 shows an embodiment of the internal transport system 190 as a conveyor belt system 200. The temperature controlled shelves 140 may be divided into a number of columns 210 with the products 10 thereon. Each or some of the columns 210 may have a column conveyor belt 220 positioned thereabout or a similar type of product drive means. The column conveyor belts 220 also may be in communication with a transverse conveyor belt 230 or a similar type of product drive means in this example, the transverse conveyor belt 230 may be positioned at the rear of the temperature controlled compartment 130. Other vending configurations may be used herein.

In use, one of the column conveyor belts 220 may deliver a selected ambient product 30 from the scanner module 160 and deliver it to the transverse belt 230 or otherwise. The transverse belt 230 then may deliver the product 30 to one of the columns 210 so as to be temperature controlled. Likewise, the column belt 220 may dispense the corresponding temperature controlled product 40 to be vended to the vending port 180 or otherwise via gravity or otherwise. Other vending procedures may be used herein.

Figure 4:
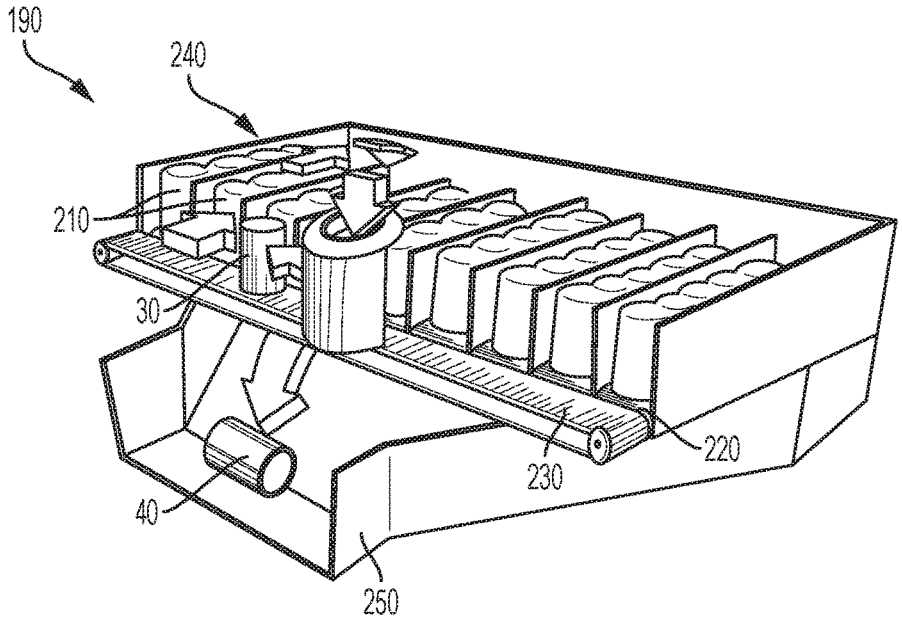
FIG. 4 is a perspective view of an alternative embodiment of the internal transport system as may be used with the merchandiser of FIG. 1.

FIG. 4 shows a further embodiment of the internal transport system as a conveyor belt and chute system 240. The conveyor belt and chute system 240 also may include a number of columns 210 with column conveyor belts 220 thereon as well as a transverse conveyor belt 230 or a similar type of drive means. In this case, the transverse conveyor belt 230 may be positioned about the scanner module 160. Other positions may be used herein. A chute 250 may be positioned beneath the shelf 140 and in communication with the vending port 180. Other vending configurations may be used herein.

In use, the transverse conveyor belt 230 may remove the selected ambient product 30 from the scanner module 160 and deliver it to the appropriate column 210 to be temperature controlled. The column conveyor belt 220 then may position the ambient product 30 onto the column 210 while also dispensing the corresponding temperature controlled product 40 into the chute 250 via gravity or otherwise. Alternatively, a positioning bar 260 may push the selected ambient product 30 into the appropriate column 210. Other vending procedures may be used herein.

Figure 5:
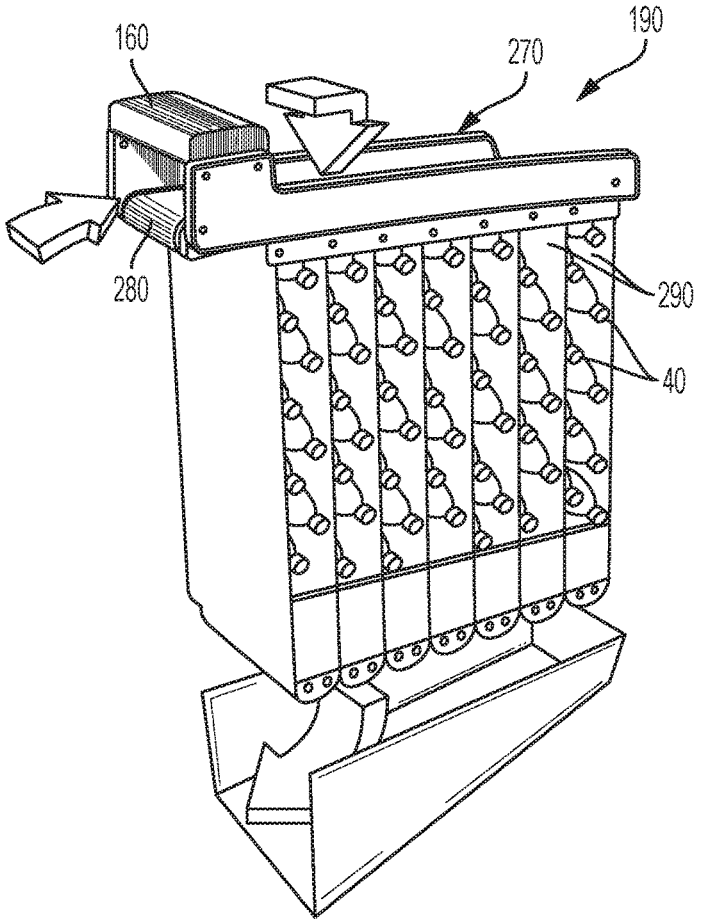
FIG. 5 is a perspective view of a further alternative embodiment of the internal transport system as may be used with the merchandiser of FIG. 1.

FIG. 5 shows a further embodiment of the internal transport system as a vertical product system 270. The vertical product system 270 may include the scanner module 160 positioned on top of the temperature controlled compartment 130. The vertical product system 270 may include a top conveyor 280 while the temperature controlled compartment 130 may include a number of vertical chutes 290 in communication therewith as the temperature controlled shelves 140. Other vending configurations may be used herein.

In use, a selected ambient product 30 may be read by the scanner module 160 and then travel along the top conveyor 280 into one of the chutes 290. Likewise, the corresponding temperature controlled product 40 may drop out of the chutes 290 and into the vending port 180 under gravity or otherwise. Alternatively, a number of the angled shelves 140 may be used such that the top conveyor 280 may deliver the ambient product 30 to the back of one of the shelves 140 and the temperature controlled product 40 may exit from the front of one of the shelves 140. A vertical transport system also may be used herein. Other vending procedures may be used herein.

Figure 6:
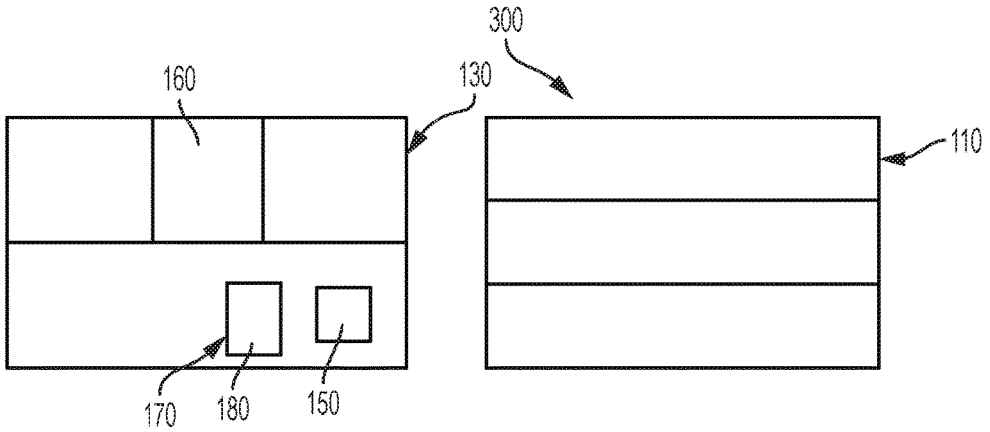
FIG. 6 is a schematic view of an alternative embodiment of a merchandiser as may be described herein.
Figure 7:
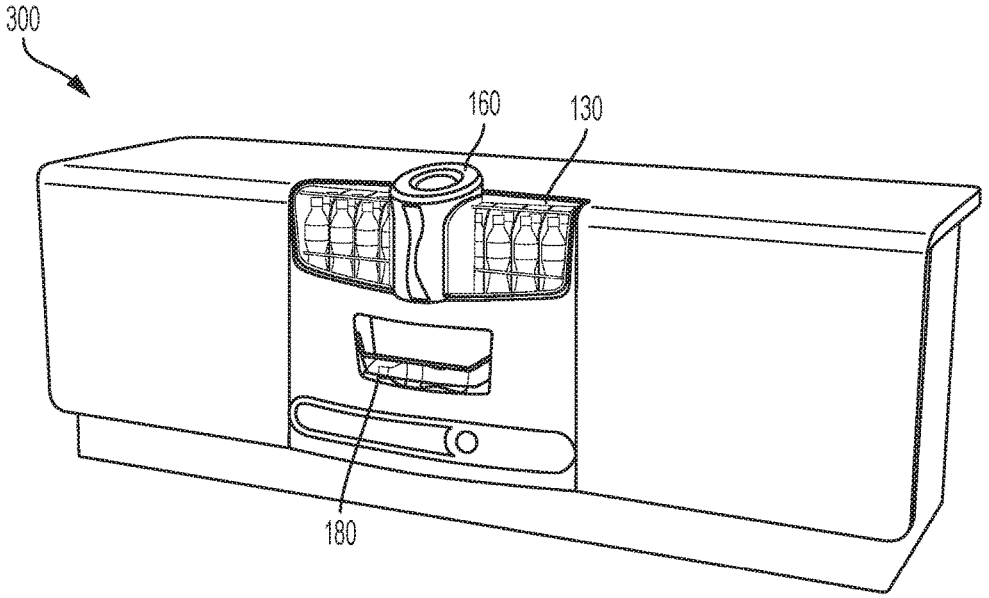
FIG. 7 is a perspective view of an example of the merchandiser of FIG. 6.

FIGS. 6 and 7 show a further embodiment of a merchandiser 300. In this embodiment, the merchandise 300 may be modular with the ambient compartment 110 separate from the temperature controlled compartment 130. Although the scanner module 160 is shown as being part of the temperature controlled compartment 130, the scanner module 160 also may be positioned at any convenient location. Likewise, the heating/cooling module 150 is shown as being positioned within the temperature control compartment 130 but also could be positioned elsewhere as may be desired. Moreover, only the temperature controlled compartment 130 may be used. Other configurations may be used herein.

Figure 8:
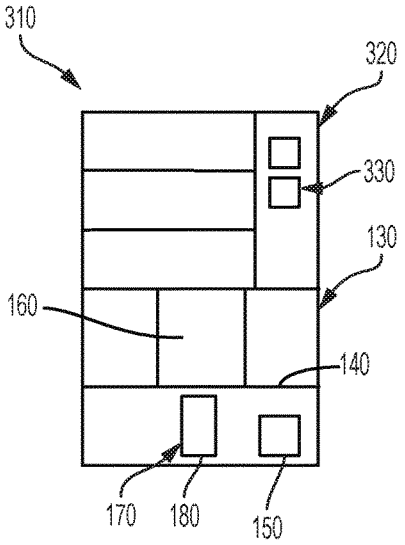
FIG. 8 is a schematic view of a further alternative embodiment of a merchandiser as may be described herein.
Figure 9:
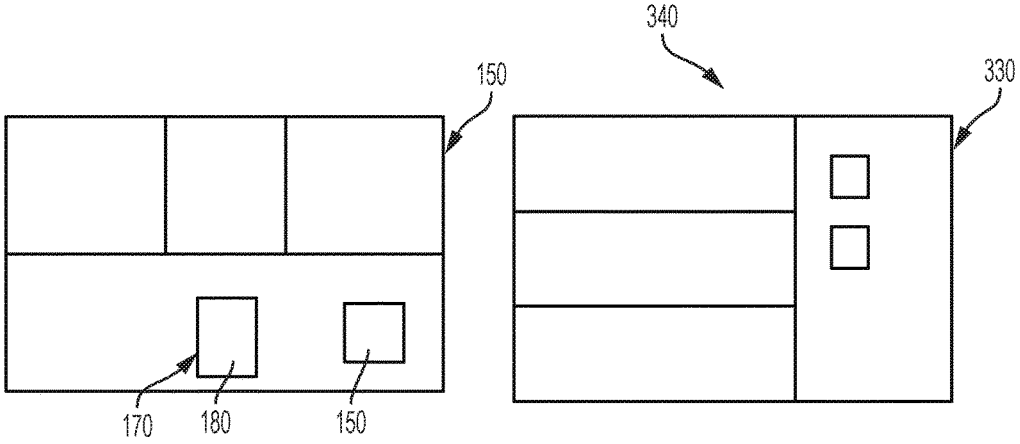
FIG. 9 is a schematic view of a further alternative embodiment of a merchandiser as may be described herein.

FIG. 8 shows a further embodiment of a merchandiser 310. The merchandiser 310 may include a vending compartment 320 instead of the ambient compartment 110. The vending compartment 320 may include conventional vending controls 330 such as selection panels and payment devices. A consumer may make a product selection at the vending compartment 320. The vending compartment 320 may deliver the ambient product 30 to the temperature controlled compartment 130 and/or the scanner module 160. The corresponding temperature controlled product 40 then may be vended as above. The vending compartment 320 may be at ambient or any desired temperature. As is shown in FIG. 9, a merchandiser 340 also may be modular with the vending compartment 320 separate from the temperature controlled compartment 130. Other configurations may be used herein.

In an alternative embodiment, the merchandiser 310 may include an ambient glass front compartment that resembles a glass front cooler, but operates at ambient temperature. The glass front portion of the merchandiser 310 may sit integrally with or merely proximate to the temperature controlled compartment 130, and may be accessed in response to a payment operation that allows the door to be opened via, a payment module in response to completing a valid transaction.

Figure 10:
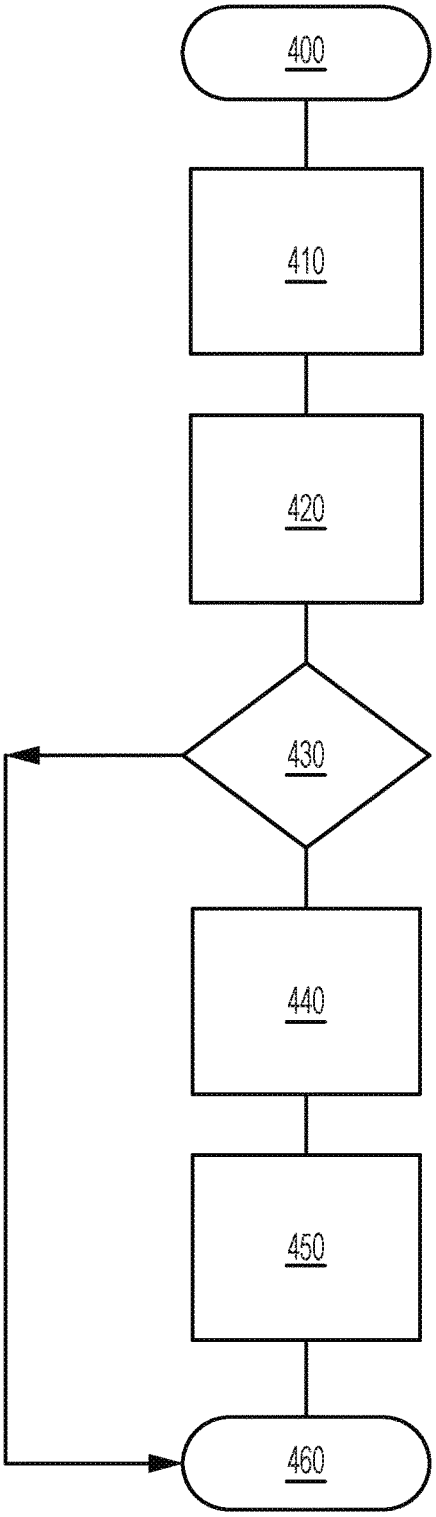
FIG. 10 is a flowchart showing a number of steps in the dispensing of a product in the merchandiser described herein.

FIG. 10 shows a flowchart of several of the process steps that may be used herein in providing the product 110 to a consumer. The process starts at step 400 in which the consumer approaches the merchandiser 100. At step 410, the consumer may remove one of the products 10 from one of the ambient compartment shelves 120 of the ambient compartment 110, the selected ambient product 30. At step 420, the consumer may place the selected ambient product 30 in the scanner module 160. At step 430, the scanner module 160 identifies the product 30 therein. If the product 30 is identified, the process continues to step 440. If not, the process is terminated. At step 440, the internal transport system 190 may dispense a temperature controlled product 40 to the vending port 180 that is temperature controlled and corresponds to the selected ambient product 30. At step 450, the internal transport system 190 may position the ambient product 30 into the appropriate column 210 in the temperature controlled compartment 130 so as to be temperature controlled and for later use as the temperature controlled product 40. The method ends at step 460. Other method steps may be used herein.

The merchandiser 100 may provide for at least a degree of product "purity", i.e., only a single brand, series of brands, or brands of a specific company may be recognized by the scanner module 160 such that any other products 10 or brands may be rejected. This may be accomplished, for example, by the scanner module 160 being adapted to recognize only predetermined products, rejecting all others by default. Further, a percentage of the products 10 therein may be of one brand or one company and a certain percentage may be of another. To enforce a permitted "purity" percentage, the scanner module 160 further may include a counter-mechanism to keep inventory of different products 10 on hand in the temperature controlled compartment 130 and reject certain products 10 if their proportion in the temperature controlled compartment 130 exceeds a predetermined limit. Any percentage may be used herein. A balance of products 10 likewise may or may not be found in the ambient compartment 110 and the temperature controlled compartment 130.

The use of the merchandiser 100 thus provides the impulse purchases often found with an open front cooler given the use of the ambient compartment 110. The merchandiser 100; however, also provides the energy efficiency (and potentially even great efficiency) typically found with a glass door merchandiser given the use of the relatively smaller temperature controlled compartment 130 and the general lack of temperature controls about the ambient compartment 110.

Moreover, the positioning of the scanner module 160 directly on top of the vending port 180 may give the consumer an enjoyable "instant chill" experience, i.e., simulating that the ambient product 30 was instantaneously cooled to its desired temperature as the temperature controlled product 140. The merchandiser 100 thus provides impulse purchases, energy efficiency, and an improved and enjoyable consumer experience.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A merchandiser, comprising:

a temperature controlled compartment configured to hold a plurality of different types of temperature controlled products therein corresponding to a plurality of different types of ambient products in an ambient compartment;

a vending module in communication with the temperature controlled compartment; and an identification module in communication with the vending module, the identification module adapted to receive a selected ambient product corresponding to a first type of the plurality of different types of temperature controlled products deposited by a user into the identification module and recognize the deposited selected ambient product;

the vending module adapted to automatically dispense a temperature controlled product of the first type corresponding to the deposited selected ambient product in response to the deposited selected ambient product being recognized by the identification module; the vending module further being configured to deliver the deposited selected ambient product into a respective corresponding column in the temperature controlled compartment to be temperature controlled and available for later use as a temperature controlled product of the first type.

2. The merchandiser of claim 1, wherein the vending module comprises an internal transport system in communication with the identification module and a vending port.

3. The merchandiser of claim 2, wherein the internal transport system is further in communication with the temperature controlled compartment.

4. The merchandiser of claim 3, wherein the internal transport system is adapted to transport the ambient product to the temperature controlled compartment and further adapted to transport the first temperature controlled product from the temperature controlled compartment to the vending port.

5. The merchandiser of claim 1, further comprising a payment module.

6. The merchandiser of claim 1, wherein the temperature controlled compartment comprises a cooling module.

7. The merchandiser of claim 1, wherein the ambient compartment is included within the merchandiser.

8. The merchandiser of claim 1, wherein the plurality of types of temperature controlled products comprise different brands of products.

9. The merchandiser of claim 1, wherein the identification module is further adapted to recognize a second ambient product corresponding to a second type of the plurality of types of temperature controlled products, wherein the second type is different than the first type.

10. The merchandiser of claim 1, wherein the identification module is further adapted to reject a selected ambient product that is not recognized to correspond to one of the plurality of types of temperature controlled products.

11. A merchandiser, comprising:

a temperature controlled compartment configured to hold therein a plurality of different types of temperature controlled products corresponding to a plurality of different types of predetermined ambient products;

a vending module in communication with the temperature controlled compartment; and an identification module in communication with the vending module, the identification module adapted to recognize and accept an ambient product corresponding to a first type of the plurality of types of temperature controlled products; and an internal transport system configured to:

dispense a temperature controlled product of the first type corresponding to the recognized and accepted ambient product; and deliver the ambient product into a respective corresponding column in the temperature controlled compartment to be temperature controlled for later use as a temperature controlled product.

12. The merchandiser of claim 11, wherein the plurality of types of temperature controlled products comprise different brands of products.

13. The merchandiser of claim 11, wherein the identification module comprises a counter-mechanism to keep count of the temperature controlled products within the temperature controlled compartment.

14. The merchandiser of claim 13, wherein the counter-mechanism will reject the ambient product corresponding to the first type if a percentage of the first type within the temperature controlled compartment exceeds a predetermined limit.

15. A merchandiser, comprising:

a temperature controlled compartment configured to hold therein a plurality of brands of temperature controlled products corresponding to a plurality of predetermined brands of ambient products;

a vending module in communication with the temperature controlled compartment; and an identification module in communication with the vending module, the identification module adapted to recognize an ambient product corresponding to a first brand, wherein the ambient product is from the plurality of predetermined brands of ambient products;

wherein the vending module is adapted to automatically dispense a first temperature controlled product of the first brand corresponding to the recognized ambient product in response to the ambient product being recognized by the identification module; and further wherein the vending module is adapted to transport the ambient product from the identification module to a corresponding location of the brand of the temperature controlled product within the temperature controlled compartment.

16. The merchandiser of claim 15, wherein the identification module is further adapted to recognize a second ambient product corresponding to a second brand of the plurality of brands of temperature controlled products, wherein the second brand is different than the first brand.

17. The merchandiser of claim 15, wherein the vending module comprises an internal transport system in communication with the identification module, the temperature controlled compartment, and a vending port.

18. The merchandiser of claim 17, wherein the internal transport system is adapted to transport the ambient product to the temperature controlled compartment and further adapted to transport the first temperature controlled product from the temperature controlled compartment to the vending port.

19. The merchandiser of claim 15, wherein the temperature controlled compartment comprises a cooling module.

20. The merchandiser of claim 15, further comprising a payment module.

* * * * *